United States Patent [19]

Hackman et al.

[11] Patent Number: 4,993,468

[45] Date of Patent: Feb. 19, 1991

[54] WINDOW WITH AUTOMATIC SCREEN

[76] Inventors: William A. Hackman, 561 So. 8th St., Grover City, Calif. 93433-2631; Leonard A. Miller, 260 Miles St., Santa Maria, Calif. 93454

[21] Appl. No.: 386,423

[22] Filed: Jul. 28, 1989

[51] Int. Cl.[5] ..... E06B 9/08

[52] U.S. Cl. ..... 160/27; 160/100; 160/273.1

[58] Field of Search ..... 160/27, 28, 29, 99, 160/100, 102, 271, 273.1, 40, 90; 16/87.6 R, 87.6 W, 87.8, 96 L

[56] References Cited

U.S. PATENT DOCUMENTS

| | | | |
|---|---|---|---|
| 1,039,411 | 9/1912 | Jones . | |
| 1,078,827 | 11/1913 | Bunnell . | |
| 1,294,094 | 2/1919 | Groff . | |
| 1,329,929 | 2/1920 | Sandberg . | |
| 1,849,371 | 3/1932 | Gronbech | 160/27 X |
| 1,922,286 | 8/1933 | Gronbech | 160/99 X |
| 1,980,990 | 11/1934 | Gronbech | 160/99 X |
| 2,015,993 | 10/1935 | Drake | 160/99 X |
| 2,261,443 | 11/1941 | McGaw . | |
| 2,349,226 | 5/1944 | Thomas | 160/273.1 |
| 2,457,491 | 12/1948 | Ramsey | 16/96 L |
| 3,005,489 | 10/1959 | Crocker et al. . | |
| 3,324,597 | 6/1967 | Rich | 160/90 X |
| 3,911,990 | 10/1975 | Hoover et al. | 160/100 |
| 4,044,504 | 8/1977 | Nakada | 160/90 X |
| 4,098,027 | 7/1978 | Crance | 160/90 X |
| 4,651,797 | 3/1987 | Lange | 160/28 X |

FOREIGN PATENT DOCUMENTS

| | | | |
|---|---|---|---|
| 228946 | 7/1959 | Australia | 160/99 |
| 250281 | 12/1962 | Australia | 160/100 |

*Primary Examiner*—David M. Purol

*Attorney, Agent, or Firm*—Cushman, Darby & Cushman

[57] ABSTRACT

The invention concerns a window and screen system provided at the end thereof that permits a screen to be moved into position upon the opening of the window. One end of the screen is attached to the end wall of the window sash thereby allowing effective sealing when the window is closed as well as the complete hiding of the screen. The screen itself is provided with an elongated seal along each of the marginal edges. As the window opens the screen is retracted from a holding area through a seal and guide channels cooperate with the elongated seal to provide a screen sealed about each of its marginal edges regardless of the degree to which the window is opened.

7 Claims, 4 Drawing Sheets

WINDOW WITH AUTOMATIC SCREEN

FIELD OF THE INVENTION

The present invention relates to a sliding window that includes an integrally mounted screen connected to the sliding window. This allows the window to be opened together with the simultaneous positioning of a screen across the opening. The screen also retracts automatically when the window is closed.

BACKGROUND AND SUMMARY OF THE INVENTION

Background

There has been a desire for a number of years to have a screen attached to a window so that the screen is automatically moved into a position covering the opening as the window is opened. Not all of these have proven to be acceptable since it is difficult to effectively seal the edges of the screen.

Jones, U.S. Pat. No. 1,039,411 discloses a vertically movable, double sash window. A series of folded metal strips are used to connect the screen to the interior face of the bottom sash and to the interior face of the top sash. Each separate screen is held on a roll rotatably mounted in a housing located at the top and bottom of the window frame, respectively. Such housings are, however, clearly visible on top of the sills and there is no secure connection between the sides of the screen and the guides in which the screen moves that will act as a seal to keep out bugs. The screen is detachable from the sash by disengaging a hooked plate 14 from a fold 13 formed along a plate 12 attached to the interior face of the sash's bottom member.

In Bunnell, U.S. Pat. No. 1,078,827, the leading edge of the screen is retained in a metal bar itself provided with a series of holes. The front face of the sash's bottom member is provided with an equal number of spaced apart screws positioned to coincide with the openings in the metal bar. A series of rotatable levers are mounted on the sash with a free end being spaced outwardly from and movable past the heads of the screws. By positioning the metal bar on the sash with the screws aligned with and entering the holes, rotation of the levers will secure the metal bar in place on the sash thereby securing the screen on the sash. The screen is itself held in a box which is clearly visible on the sill beneath the window.

Groff, U.S. Pat. No. 1,294,094, describes a vertically moving window/screen combination with the screen held on a roll placed in an area located below the sill. The screen is again attached to the front face of the sash and will be raised together with the window. This is accomplished by a chain drive located in a vertical pocket adjacent one side of the window. The sides of the screen again ride within the window track provided on the frame and do not have any means for sealing between the screen and the frame.

In Sandberg, U.S. Pat. No. 1,329,929, another type of window unit including a screen is disclosed and includes pointed rollers provided within the tracks provided for the screen. These rollers engage the screen material to prevent it from pulling out from the track. The screen is again provided on rollers that are spring tensioned to assure wind-up of the screen when the window is closed. The rollers and associated gearing is also positioned directly on the window sill.

McGaw, U.S. Pat. No. 2,261,443, discloses a window unit where the screen includes a u-shaped metal edge that will mate with an inverted u-shaped member fastened to the front face of the sash. When the two u-shaped members are connected together the screen will follow the window. The screen material is also held on a rolled mounted in a separate case or housing mounted directly on the sill in an exposed manner.

In Crocker et al, U.S. Pat. No. 3,005,489, the feature emphasized was the detachability of the screen from the sash. Here the sash is comprised of an extruded metal member provided with a depending flange designed to cooperate with a hook member attached to the leading edge of the screen. A cam type locking member is used to lock the hook in place against the flange so that when the window is moved the screen moves in a coordinated manner. The screen is held on a spring roll mechanism mounted within a housing secured to the side members of the window frame that is also visible from the exterior of the window. Also, there is no seal provided between the sides of the screen and the frame of the window where the screen moves.

Summary Of The Present Invention

The present invention not only provides a way to include a screen as part of a window system but does so in a manner that allows the screen to move together with the window and, regardless of the extent to which the window is opened, the screen will establish a seal along its marginal edges including along the edges of the track in which it moves. The invention also attaches the screen directly to an end or closing surface of the sash rather than to the face of the sash thereby permitting the screen to be completely hidden at the end of the window structure.

By placing the point of attachment between the screen and the movable window directly on the end surface or end wall of that window, it is possible to not only completely hide the screen and screen mechanism from view when the window is closed, but sealing of the window is also improved. The sealability with respect to outdoor conditions is one of the primary advantages gained by the present invention.

The screening material itself is held in a separate area of the window at one or each end thereof. That area or portion of the window structure is itself sealed with respect to the outside and to the screen even as the latter is moved as the window opens and screening is unwound from a spring tensioned roll. The window end wall includes suitable sealing in the area adjacent the sash and in the area surrounding the screen retention area so that the edges of the window or of the sash are sealed all the way around when the window is closed.

The screen itself, when moved together with the window as the window is opened, that is in the preferred exemplary embodiment as set forth herein, will run along a track at both the top and bottom edges of the window frame. The top and bottom edges of the screen are provided with sealing strips which move along the track as the screen is moved and provide a seal between the track and the screen as the screen is retracted. The screen also extends through a seal as it is retracted from the end of the window structure where the screen is located. When the window is fully or only partially opened, the screen will be extended an equal amount and will be sealed around all of its edges including the edge attached to the window and the edge most closely adjacent the container from which the screen was withdrawn.

Other objects, features, and characteristics of the present invention, as well as the methods and operation and functions of the related elements of the structure, and to the combination of parts and economies of manufacture, will become apparent upon consideration of the following description and the appended claims with reference to the accompanying drawings, all of which form a part of this specification, wherein like reference numerals designate corresponding parts in the various figures.

DETAILED DESCRIPTION OF THE PREFERRED EXEMPLARY EMBODIMENT OF THE PRESENT INVENTION

Figure 1:
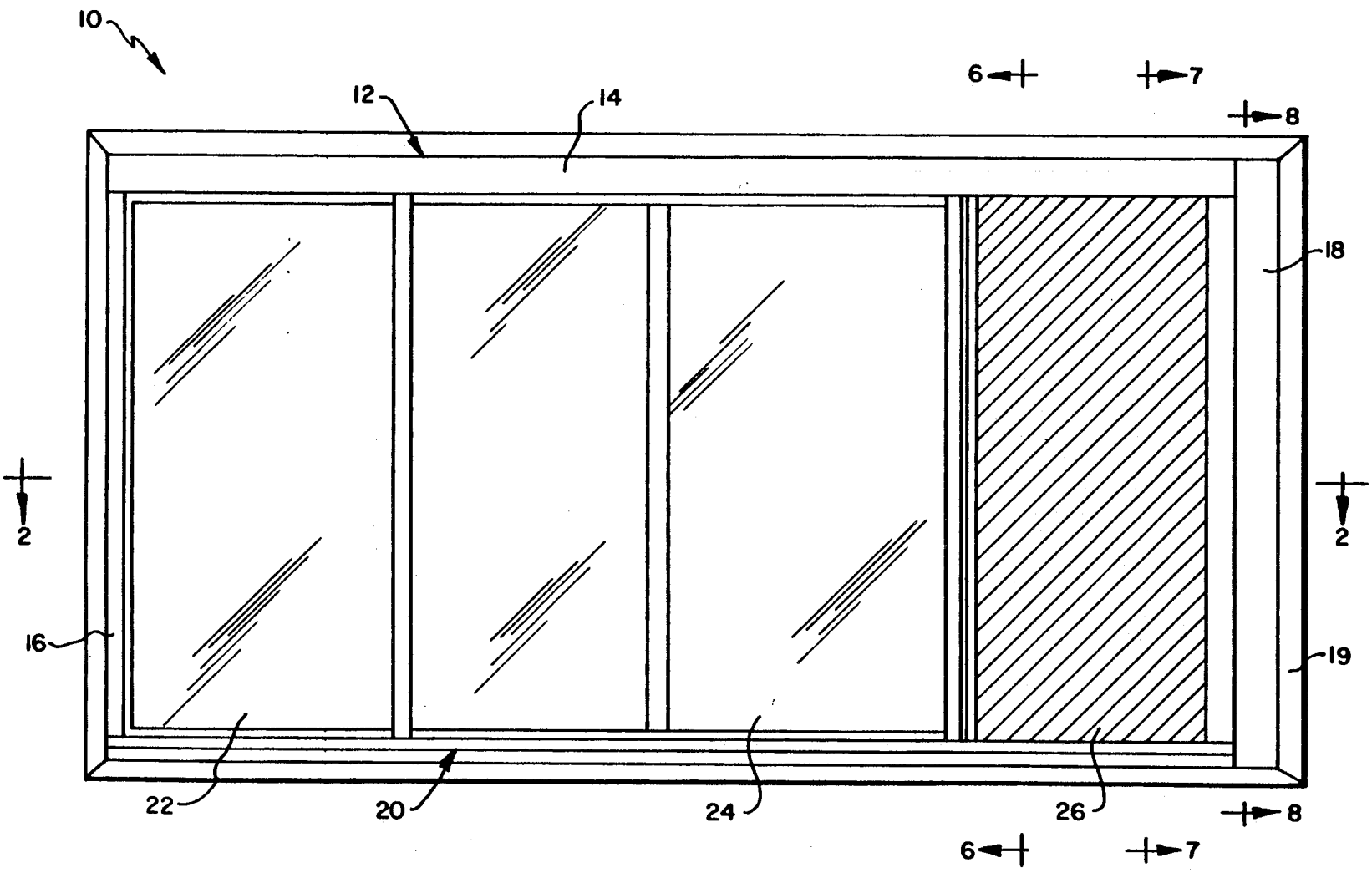
FIG. 1 is a front elevational view of a horizontal window incorporating the present invention.
Figure 2:
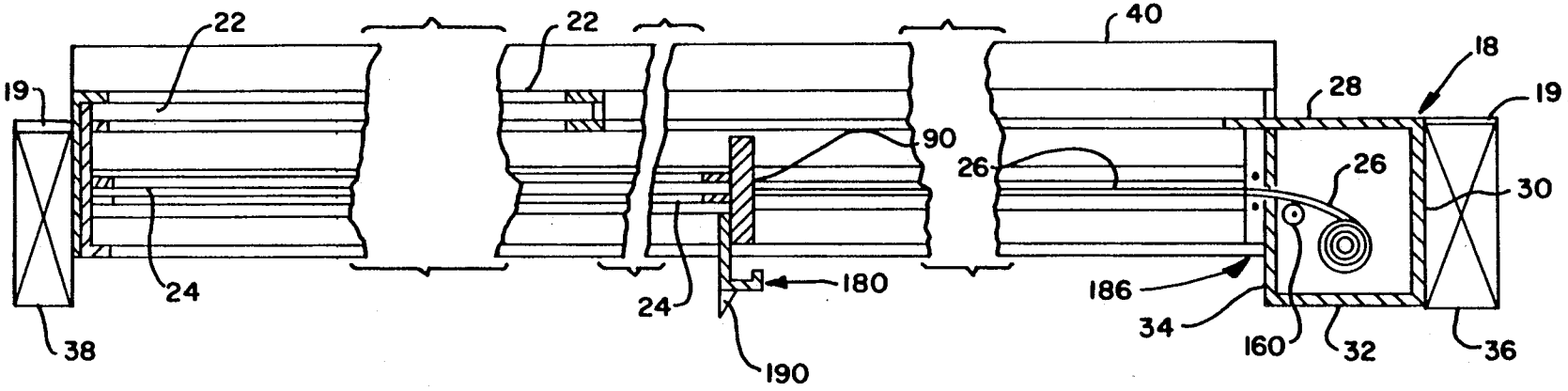
FIG. 2 is a partial cross-sectional view taken along line 2—2 in FIG. 1 showing the window partially open.

With reference first to FIGS. 1 and 2, a window is generally indicated at 10 and includes an outer frame generally referenced at 12 which is comprised of a top frame member 14, end frames 16 and 18, respectively, and a bottom frame 20. While a horizontal window is shown it should be understood that other window shapes and styles are also intended to be included as the concepts set forth will work with and be applicable to any window structure where a window sash is movable.

A mounting flange 19 is included so that it preferably extends about the entire window frame. The exact dimensions of flange 19 are not critical so long as sufficient length and width exists for the flange to overlap the studding surrounding a conventional window opening and to permit the mounting and positioning of the window therein by nailing or other conventional means.

Included within this frame 12 are two windows 22 and 24, with window 24 being shown in a partially opened condition. Since window 24 has been partially opened, its right end, as shown in FIG. 1, has moved away from the end frame section 18. This movement has caused the screen, shown at 26, to have been partially retracted from a holding container within end frame section 18. This particular section 18 is in the form of a box comprised of side walls 28, 30, 32 and 34. Side wall 34 has a particular structure and will be more fully described below. The entire window structure, as shown in FIG. 1, is preferably mounted within a wall such as between the studs 36 and 38 as shown at FIG. 2. It is also preferred and contemplated that the window will be dimensioned along conventional lines so that windows built according to the present invention could be used in lieu in view of conventional window structures and within standard sized openings therefor. This would include both original equipment and replacement windows. It must be understood, however, that the concepts of the present invention would work equally as well where custom sized windows were being manufactured. Further, the horizontal window shown in FIG. 1 is merely exemplary and vertically oriented windows would also be contemplated as coming within the scope of the present invention.

Figure 3:
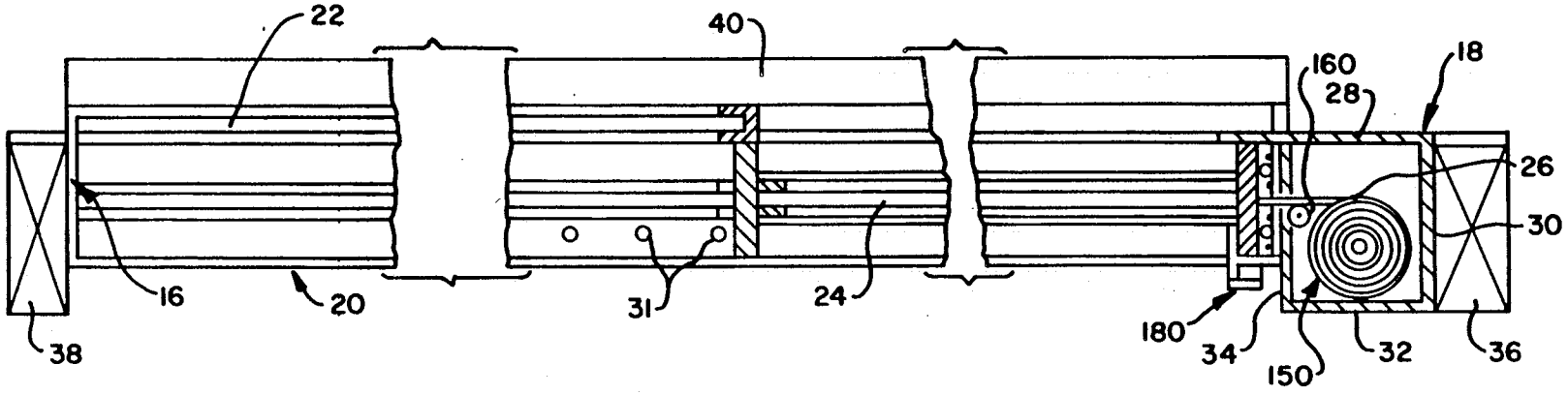
FIG. 3 is a cross-section similar to FIG. 2 but showing the window in its closed condition.

FIG. 3 shows window 24 in its closed condition. The screen 26 has been retracted within its enclosure and catch or latch 180, described below, locks the window in place. Apertures 31 can also be provided within the bottom of the frame 20 so that a locking pin (not shown) can be inserted to provide another way to lock and secure the sliding window.

Figure 5:
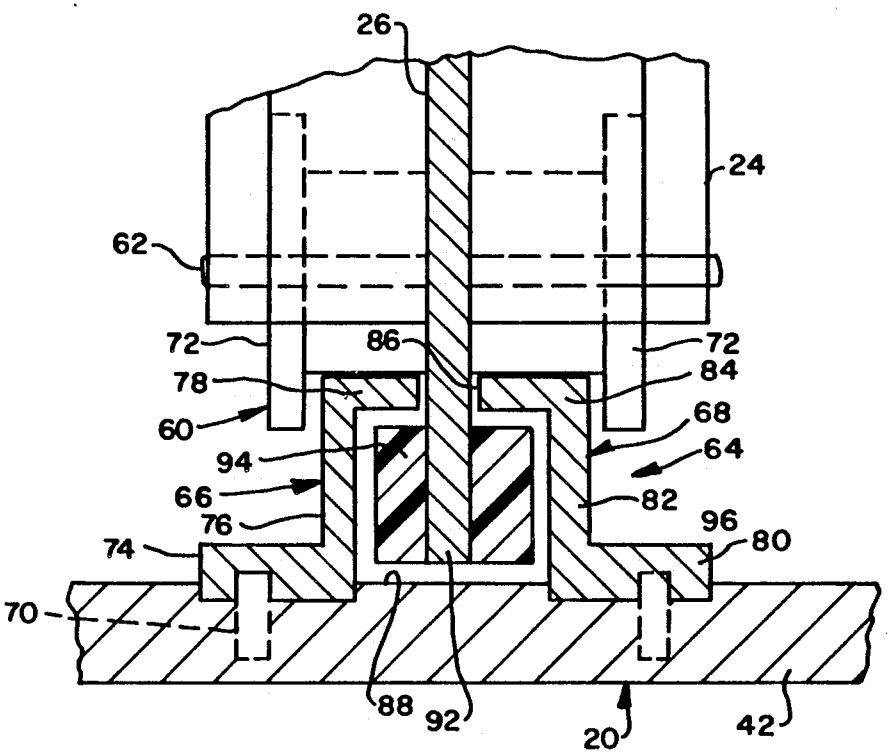
FIG. 5 is an enlarged partial cross-sectional view of a portion of the lower track assembly showing the window and the screen in a partially retracted condition.
Figure 6:
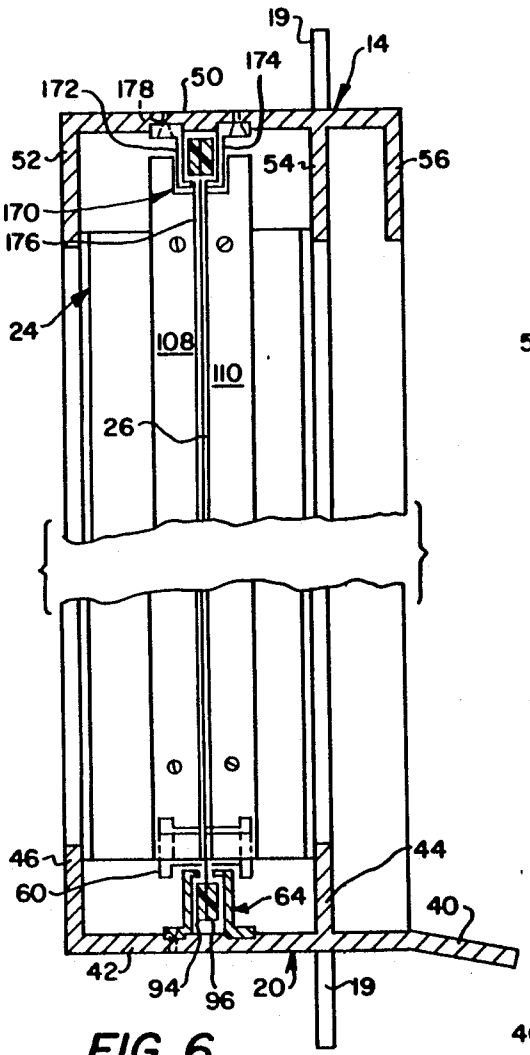
FIG. 6 is a cross-sectional view taken along line 6—6 in FIG. 1.

With reference now to FIGS. 5 and 6, the bottom frame 20 includes a sill 40, a bottom plate 42 and front and rear upstanding guides respectively shown at 44 and 46. The top frame 14 is comprised of a horizontal plate 50 from which two elongated flanges or guides 52 and 54 extend downwardly. In addition, a front depending flange 56 is also provided along the frame. This comprises the retaining member, along the length of the window, for the stationary window 22 as shown. The bottom of the stationary window can either be provided with a flange that can fit over guide 44 or the bottom can be otherwise secured to guide 44.

Figure 4:
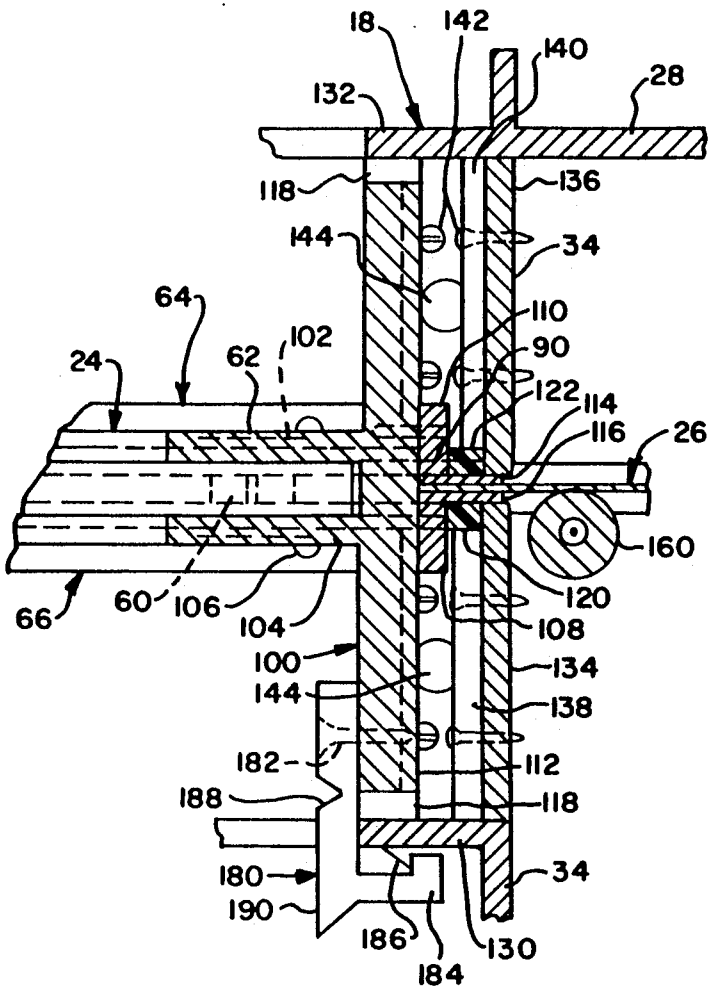
FIG. 4 is a more detailed partial cross-sectional view of the end of the window in its closed position.
Figure 8:
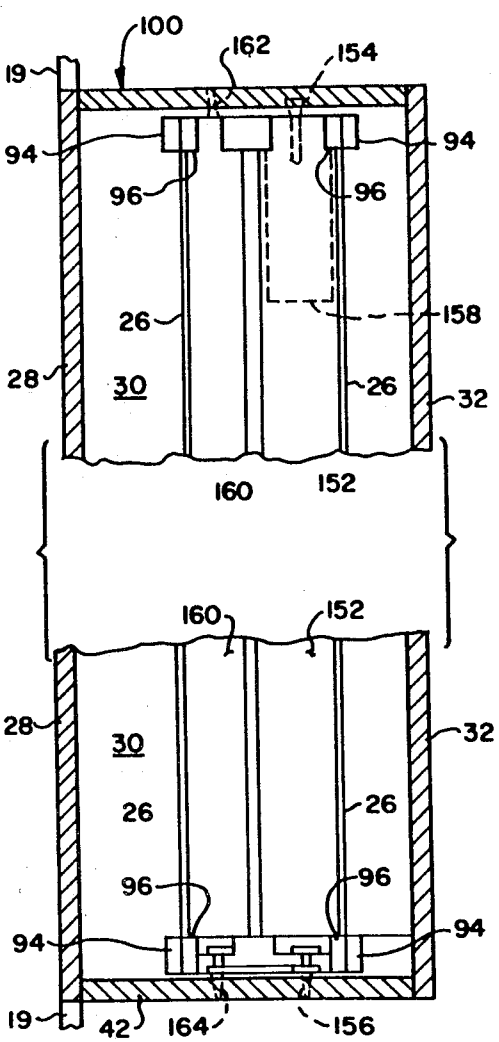
FIG. 8 is a cross-sectional view taken along line 8—8 in FIG. 1.

The top and bottom frames can be extruded as one piece materials, for example from aluminum, plastic or combinations of wood, metal or other man made materials. Similarly, they could be manufactured from separate parts although one piece extrusions are preferred. As shown in FIG. 6, window 24 fits within the structure defined between the top and bottom frames with the top fitting within the depending flanges 52 and 54 and the bottom engaging upstanding guides 44 and 46. As shown in FIGS. 4 and 5 the bottom of window 24 is provided with a plurality of rollers, one of which is indicated at 60. This is shown in greater detail at FIG. 5, with roller 60 being rotatably mounted to the window 24 by means of a through pin 62. Rollers 60 are preferably spaced apart along the bottom of window 24 and are in turn supported by a channel structure, generally indicated at 64, secured to the bottom frame. Channel structure 64 is comprised of two channel members 66 and 68 that are respectively attached to the bottom frame 20 by means of screws, one of which is indicated at 70. Each of the channel members 66 and 68 include a flat upper surface on which the center part of roller 60 is supported and moves. Roller 60 is also provided with two depending circumferentially extending flanges 72, which extend about the exterior of the channel guide 64 to assist in holding the window 24 in place and in guiding its movement.

With reference still to FIGS. 4 and 5, channel member 66 is comprised of a lower horizontal portion 74, a vertically extending member 76 and an upper horizontal member 78. In a similar fashion, channel member 68 is comprised of a horizontal bottom section 80, a vertical section 82 and an upper horizontal section 84. Channel members 66 and 68 are spaced apart, as shown at FIG. 5, so that the exposed facing interior edges of each of the horizontal member 78 and 84 are similarly spaced from each other and define a slot 86 therebetween. The interior space defined by channel members 66 and 68, together with a portion of the interior surface of frame member 20 cooperate to define an elongated channel 88. Also as shown in FIG. 5, the screen 26, held by seal strips 94 and 96, will move through the elongated slot 86 and channel 88 as window 24 is opened and screening is retracted from its holding roll.

Screen 26 includes a first end 90 attached to window 24 with a second end attached to the retraction mechanism within end frame section 18. Screen 26 also has top and bottom side edges, one of which is shown at 92 in FIG. 5. Each of these side edges include seals, as shown at 94 and 96, which extend along the entire edge. Seals 94 and 96 are preferably comprised of a plastic or rubber material adhered, such as by adhesive, to the elongated side edge of the screen. However, other materials could be used and the attachment procedure could vary as well. It is only important that the sealing material be provided along the edge and be firmly secured to the screen material. The combined structure then of the seals 94, 96 and the side edge of the screen 92 will all move within the elongated channel 88. Not only will the seals 94 and 96 prevent the screen 26 from pulling out of channel 88, but they will also prevent movement of the screen out of the elongated slot 86 and will assist in placing the proper tension on the screen material to keep the screen material substantially flat. As the screen is moved horizontally along the window the seals 94 and 96 will come into contact with the horizontal portions 78 and 84 of the channel members 66 and 68 thereby tending to raise them against the interior surfaces of horizontal members 78 and 84. This will assist the sealing of the lower edge of the screen along the length of slot 86 and serve to hold the seals 94 and 96 and, consequently screen 26, in place.

With reference to FIG. 4, the right hand end of window 24, to which screen 26 is attached, includes a T-shaped mounting member or plate, generally indicated at 100, which includes two spaced apart flange members 102 and 104. Window 24 is received between members 102 and 104 and secured by screws 106 or other convenient means. A rubber channel or gasket would be used within the connection between the window 24 and the mounting plate 100. Two vertically extending L-shaped brackets 108 and 110 are screwed or otherwise connected to the central part of the interior surface 112 of mounting plate 100. Brackets 108 and 110 are spaced apart and include, as shown in FIG. 4, rearwardly extending flanges 114 and 116. The end 90 of screen 26 is placed within the space defined between flanges 114 and 116 and is secured thereto. In fact, screen 26 can be held between members 114 and 116 by a variety of techniques, one of which would be by screws. Brackets 108 and 110 preferably extend along the full edge length of window 24, as will mounting plate 100. It should also be understood that preferably mounting plate 100, flange members 102 and 104 will constitute a one piece structure and will form part of the window frame. However, these elements could be separate pieces and still be within the scope of the invention. Suitable seals 118 are also provided along each of the vertical edges of plate 100 in order to seal against the sides of the window frame. These seals 118 can be comprised of felt strips or rubber or polymeric seals, it only being important to seal between the edges of mounting plate 100 and the window frame. In addition to these seals further seals or stops 144 are also employed. Stops 144 are attached to plate wall 140 and will have a thickness so that when window 24 is closed the interior surface 112 of plate 100 and the end wall or surface of window 24, will engage stops 144. This will also appropriately position the window at the correct closed position.

The members 114 and 116 also extend between two fiber seals 120 and 122 which are themselves attached to the removable wall pieces 134 and 136 so as to extend vertically there along. These fiber seals keep screen 26 clean and serve to brush debris and larger articles off the screen thereby preventing such material from entering the enclosure where screen 26 is wound.

Wall 34, partially described above, is comprised of a fixed portion as shown at the bottom of FIG. 4, and a removable portion through which the screen is moved. Part of the fixed portion includes the member extending toward the windows as indicated at 130 within which the end of window 24 is received when closed. The opposite wall 28 also includes a member 132 extending outwardly from wall 34 toward the window. It is between portions 130 and 132 that seals 118 serve to seal about the end of window 24 and specifically about the vertical sides of plate 100.

Figure 7:
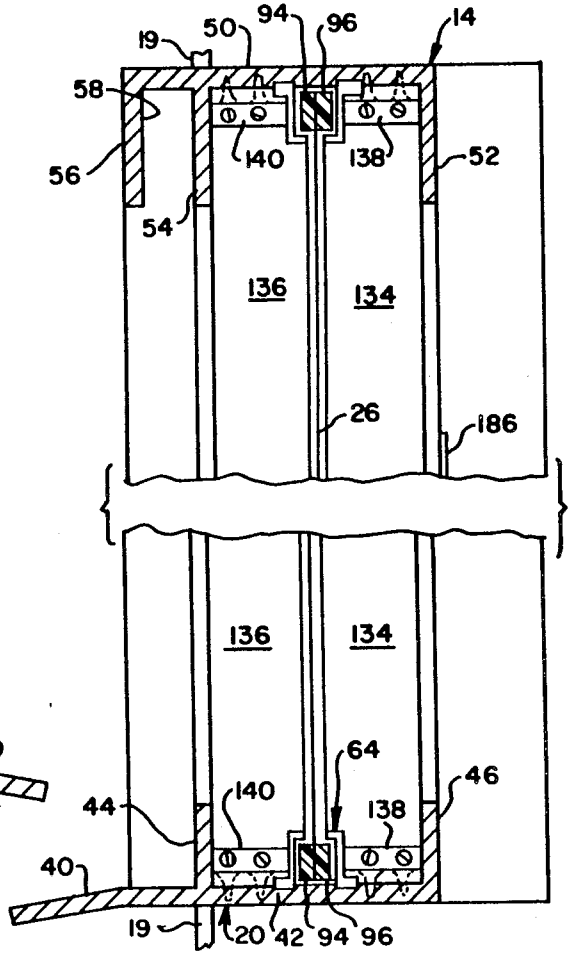
FIG. 7 is a cross-sectional view taken along line 7—7 in FIG. 1.

Wall 34 also include's two removable portions 134 and 136, with portions 134 and 136 being held in place by brackets 138 and 140, respectively. Brackets 138 and 140 are connected both to the bottom frame 20 and to the removable portions of wall 34, specifically portions 134 and 136, by screws such as are shown in 142. This is also shown in FIG. 7. Should it become necessary to replace or repair the screen retraction mechanism, generally indicated in FIGS. 2 and 3 at 150, screws 142 can be removed after the window 24 has been moved to its open position, thereby allowing wall portions 134 and 136 to be removed exposing the retraction mechanism 150.

Retraction mechanism 150 is a conventional roller retractor, capable of applying continuous tension to screen 26 while also permitting the screen material to be withdrawn against the spring force as the window 24 is moved into an open position and taken up again upon the closing of the window. This retraction mechanism structure includes, as best shown in FIGS. 2–4 and 8, a screen retraction roller 152 rotatably mounted within the end frame section 18 by means of pins 154 and 156, respectively, at the top and bottom of roller 152. This roller also includes an internal, spring tensioned retractor mechanism 158 located internally within roller 152 in order to provide sufficient spring force, less than the frictional sliding force required to open window 24, to keep screen 26 taut when retracted into an open position, and of sufficient force to rewind and take up screen 26 as window 24 is moved toward its closed position.

Screen 26 also passes over a guide roller 160, which extends along the height of the cavity within end frame section 18. Roller 160 is also rotatably mounted by pins 162 and 164, respectively, at the top and bottom of roller 160. Preferably, notches are cut in the side of roller 160, adjacent the top and bottom, to receive the seals at the top and bottom of the screen. This way the surface of roller 160 will engage both the screen and the seals as the screen moves relative to its enclosure providing guidance for both the screen and its seals.

The upper edge of screen 26 is also provided with seals 94 and 96, which travel within a channel structure generally indicated at 170. This upper channel structure is constructed in a manner similar to that shown for the channel structure at 64, and is comprised of two generally S-shaped members 172 and 174, which provide a similar slot 176 between those members through which screen 26 passes and an elongated channel 178 within which seals 94 and 96 move. It might be noted that the elongated channels 88 and 178 may have their interior surfaces provided with a coating that makes the sliding movement of the seals 94 and 96 therethrough occur more easily. One such coating could be teflon.

Accordingly, as window 24 is opened, screen 26 will be unrolled from roller 152 and directed by roller 160, around which it travels into the vertical slot defined between plates 134 and 136. An the screen moves along the window frame all of its marginal edges will remain sealed. End 90 is sealed between members 114 and 116, the side edges are sealed by seals 94 and 96 as they slide through channels 88 and 178 and the screen is sealed across its width as it is withdrawn through the slot between removable walls 134 and 136. When window 24 is closed, as shown in FIG. 4, the screen 26 will have been taken-up by the retraction mechanism 150 and interior surface 112 of plate 100 will contact members 144 and seals 118 will contact wall members 130 and 132 thereby sealing the end of window 24 within frame 12.

A lock member generally indicated at 180 is preferably constructed of a flexible plastic, such as polyethylene, and it is attached to plate 100, for example by screw 182. Lock 180 has an L-shape and the forward portion 184 is designed to snap over a projection 186 provided on the exposed surface of member 130. The lock 180 also includes a vertically extending v-shaped cut 188 that will allow the lock member 180 to bend about that point with the remaining material acting as a living hinge. A handle 190 is also provided on the front of lock 180 to provide a place to grip or push lock into an open condition where portion 184 is raised away from projection 186. Thus when the window is closed, the portion 184 will be retained by stop 186.

While the invention has been described in connection with what is presently considered to be the most practical and preferred embodiment, it is to be understood that the invention is not to be limited to the disclosed embodiment, but on the contrary, is intended to cover various modifications are equivalent arrangements included within the spirit and scope of the appended claims.

I claim:

1. A window ad self-screening system comprising an outer supporting frame, at least one window slidably retained within said frame and movable from one end of said frame toward the opposite end thereof between a first closed position and a second open position, a window screen mounted on means for retaining said screen in a wound condition and for allowing said screen to be unwound therefrom and taken up thereby, said screen being positioned on said system adjacent the end corresponding to the first closed position of said window said screen having a first end attached to said window so that said first end will move together with said window and a second end attached to said retaining means, said screen further including top and bottom side edges, said retaining means including first sealing means for sealing about said screen as said screen moves with said window, and second sealing means secured along said side edges, said frame further including means defining elongated channels for supporting said at least one window and for slidably receiving said second sealing means so that as said window moves between said first and second positions the screen will follow that movement and simultaneously establish a seal about the marginal edges of said screen.

2. A window system as in claim 1 wherein said at least one window includes an end wall and said screen is secured to said end wall.

3. A window system as in claim 1 wherein said at least one window is slidingly supported by said channel means.

4. A window system as in claim 3 wherein said window includes a plurality of rollers rotatably mounted to the window so as to be in engagement with said channel means.

5. A window system as in claim 1 wherein said channel means include interior surfaces and a coating applied thereon within said elongated channels to reduce sliding friction between said interior surfaces and said second sealing means.

6. A window system as in claim 5 wherein said second sealing means comprises at least one elongated member secured along said screen.

7. A window system as in claim 6 wherein said elongated member is comprised of a synthetic material.

* * * * *